United States Patent [19]

Prunbauer et al.

[11] Patent Number: 4,665,726

[45] Date of Patent: May 19, 1987

[54] LOCK CYLINDER WITH ROTATABLE MAGNETIC TUMBLERS

[75] Inventors: Kurt Prunbauer, Herzogenburg; Erich Csapo, Vienna, both of Austria

[73] Assignee: Evva-Werk Spezialerzeugung von Zylinder - und Sicherheitsschlossern Gesellschaft mbH & Co., Vienna, Austria

[21] Appl. No.: 801,609

[22] Filed: Nov. 25, 1985

[30] Foreign Application Priority Data

Nov. 26, 1984 [AT] Austria ..... 3737/84

[51] Int. Cl.[4] ..... E05B 47/00

[52] U.S. Cl. ..... 70/276; 70/365; 70/422

[58] Field of Search ..... 70/276, 413, 365, 360, 70/422

[56] References Cited

U.S. PATENT DOCUMENTS 4,220,021 9/1980 Burger ..... 70/380

FOREIGN PATENT DOCUMENTS 341901 3/1978 Austria .

357430 7/1980 Austria .

3230633 2/1984 Fed. Rep. of Germany ..... 70/276

*Primary Examiner*—Robert L. Wolfe

*Attorney, Agent, or Firm*—Karl F. Ross; Herbert Dubno

[57] ABSTRACT

The lock cylinder comprises a cylinder housing and a cylinder core having at least one rotatable magnetic tumbler supported therein, wherein in the cylinder core at least one axially slidable bolt member is provided, whose slidability is controlled by the rotatable magnetic tumblers. The bolt member has two control tips positioned at opposite ends thereof, which are guided with two control surfaces mounted, so as to be nonrotatable with respect to the cylinder housing and positioned opposing each other. Thus a positively actuated control of the bolt member is provided, which is independent of the sliding force, which would be provided by a spring. One of the control tips is slidable against an elastic restoring force, whereby, after a certain limiting force has been exceeded, a relative displacement between the control surfaces of the bolt member occurs so that a subsequent rotation of the cylinder core without collateral axial displacement of the bolt member is made possible.

7 Claims, 3 Drawing Figures

LOCK CYLINDER WITH ROTATABLE MAGNETIC TUMBLERS

CROSS REFERENCE TO RELATED APPLICATION

This application discloses subject matter related to that of the commonly owned copending application, Ser. No. 782,493, filed 10-1-85.

FIELD OF THE INVENTION

Our present invention relates to a key-operated lock, and, more particularly, to an improved lock cylinder for a key-operated lock.

BACKGROUND OF THE INVENTION

A lock cylinder, as described, for example, in Austrian Pat. No. AT 341 901, can comprise a cylinder housing and a cylinder core having at least one, and usually a plurality, of rotatable magnetic tumblers supported therein.

In the cylinder core at least one axially slidable bolt member is provided, whose slidability is controlled by the rotatable magnetic tumblers, and the bolt member has at least one projection, preferably a plurality of projections, directed toward the exterior of the lock cylinder. The inside wall of the cylinder housing has at least one circular groove and an axially running groove.

The circular grooves are located axially, so that in an axially shifted position of the bolt member, in which contacting elements protruding toward the inside of the lock cylinder lie in notches of the rotatable magnetic tumblers, i.e. when the correct key is inserted, the previously restrained projections of the locking element are in a position permitting rotation of the cylinder core.

Other such lock cylinders are described in, for example, the Austrian Pat. No. AT-PS 357 430. By comparison with these systems, it would be advantageous to reduce the forces operating, during faulty or incorrect locking, on the rotatable magnetic tumblers of the lock cylinder, in order to prevent probable damage to the rotatable magnetic tumblers, and to be able to select reduced dimensions for the contacting elements and other components and thus to increase the mechanical precision of the lock.

Furthermore it would also be an advantage to reduce the influence of the environment, including that of weather, dust, corrosive material, and the like, on the relatively movable components of the lock cylinder and the cylinder core.

In the lock cylinder structure according to the Austrian Pat. No. AT-PS 357 430 a bolt member is used, which is held under an elastic restoring force form one side by means of a spring or the like, and is pressed with a control tip against the control surface of a locking ring. The operation of the locking ring as a force-limiting coupling depends on its mechanical precision.

For the release of the force-limiting coupling comparatively large applied forces are required, which act disadvantageously on the rotatable magnetic tumblers.

With faulty mounting, bending and compression of the locking ring can occur, so that precise operation can not be maintained.

By comparison with the device of Austrian Pat. No. AT-PS 357 430, it would be advantageous to provide a positively actuated control of the bolt member and its shifting, which is independent of the sliding force provided by a spring.

OBJECTS OF THE INVENTION

The principal object of our invention is to avoid the above described disadvantages and to provide a lock cylinder which satisfies high standards of lock precision and operating reliability.

It is a general object of our invention, therefore, to provide an improved lock cylinder.

It is also an object of our invention to provide an improved lock cylinder having a greater mechanical precision than those of the prior art.

It is also an object of our invention to provide an improved lock cylinder having a positively actuated control of its bolt member, which is independent of the sliding force provided by a spring.

It is also an object of our invention to provide an improved lock cylinder, in which damage to the rotatable magnetic tumblers due to excessive force during lock action is prevented, and thus also to be able to make components of the lock cylinder whose dimensions are reduced from those of the prior art.

It is yet another object of our invention to provide an improved lock cylinder in which the mechanical precision of the lock is increased by providing a mechanism free from the action of corrosive materials, moisture, and the like.

SUMMARY OF THE INVENTION

These objects and others, which will become more apparent hereinafter are attained in accordance with our invention in a lock cylinder comprising a cylinder housing and a cylinder core having at least one rotatable magnetic tumbler supported therein, wherein in the cylinder core at least one axially slidable bolt member is provided having at least one projection directed toward the exterior of the lock cylinder and at least one contacting element extending toward the interior of the lock cylinder.

The bolt member is mounted at least partially rotatably in an axially running groove on the inside wall of the cylinder housing also having at least one circular groove therein, which is positioned axially, so that, when the bolt member is slid axially into a position, in which each of contacting elements engages an associated notch in one of the rotatable magnetic tumblers, because the rotatable magnetic tumblers are properly oriented therefor by insertion of a correctly formed key in the lock cylinder, the projections are engageable in the circular groove, so that the bolt member may be rotated further to open the lock cylinder.

According to our invention the bolt member comprises two control tips positioned at opposite ends thereof, which are guided by two control surfaces mounted so as to be nonrotatable with respect to the cylinder housing and positioned opposing each other, whereby a positive control of the movement of the bolt member is provided.

A first of these control surfaces has a concave segment and a second of the control surfaces can have a convex segment. One of the control tips is slidable against an elastic restoring force, whereby after a certain limited force has been exceeded a relative displacement between the control surfaces of the bolt member is possible, such that the projections of the bolt member can engage in the circular grooves of the cylinder housing and only a rotation of the cylinder core is required to unlock the lock cylinder.

According to a preferred embodiment of our invention the one of the control tips slidable under an elastic restoring force comprises a pivotally supported first control pin mounted in a cavity of the bolt member. The displacement of the first control pin toward the exterior of the lock cylinder is bounded by a limit stop device.

In a further preferred embodiment of our invention the limit stop device comprises a pin recess in the side of the first control pin and a second control pin mounted rigidly in the bolt member substantially perpendicular to the first control pin, the second control pin being substantially smaller than the pin recess and extending into the pin recess, so as to limit the axial displacement and rotatability of the first control pin.

Furthermore according to another preferred embodiment of our invention the first control pin is pivotable about its longitudinal axis, so that the rotary position of the one of the control tips slidable under the elastic restoring force can follow the shape of the concave segment of the first one of the control surfaces.

Finally according to a particularly desirable specific embodiment of our invention the bolt member comprises a contacting slider having the contacting elements attached thereto and a slider bolt, the contacting slider and the slider bolt being mounted on a core covering or shell supported rigidly in the cylinder core, and the contacting slider and the slider bolt are connected to each other by at least one cam projecting through an opening in the core covering, and wherein in the vicinity of the opening in the core covering or shell between the contacting slider and the slider bolt a sealing member is provided through which the cam projects, whereby the interior of the lock is kept free of dust, moisture and the like.

BRIEF DESCRIPTION OF THE DRAWING

The above and other objects, features, and advantages of our invention will become more readily apparent from the following specific description, reference being made to the accompanying drawing in which.

SPECIFIC DESCRIPTION

Figure 1:
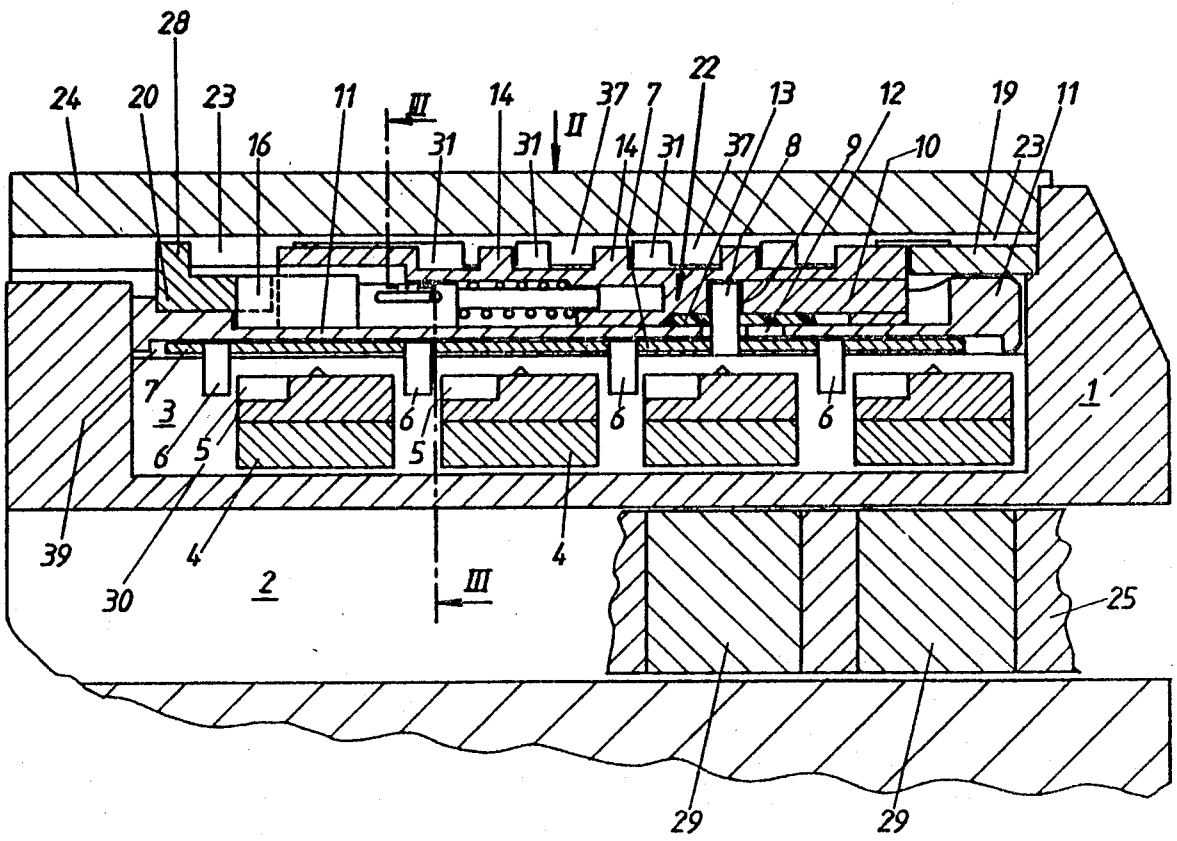
FIG. 1 is a partially cutaway cross sectional view of a preferred embodiment of a lock cylinder according to our invention taken along section line II of FIG. 2 in a plane containing the axes of the rotatable magnetic tumblers.

The basic structure of the lock cylinder of our invention is similar to that described in Austrian Pat. No. AT-PS 357 430.

In the cylinder core 1 a chamber 3 is positioned parallel to the key channel 2, in which the rotatable magnetic tumblers 4 are positioned so as to be freely rotatable. By inserting the correct key 25 (shown broken off in FIG. 1) the rotatable magnetic tumblers 4 are brought into the position shown in FIG. 1, whereby the notches 5 are aligned in such a way that the contacting elements 6 of the bolt member 22 can be axially displaced, so as to enter the notches 5 of the rotatable magnetic tumblers 4 (see the aforementioned copending application).

The bolt member taught in Austrian Pat. No. AT-PS 357 430, is formed as a single piece and has both the function of making contact with the tumblers and also that of locking the lock cylinder against rotation. By contrast with that system the bolt member 22 of our invention comprises a contacting slider 7 and a slider bolt 10.

The contacting slider 7 can be pressed against the tumblers 4 and has projecting contacting elements 6, which engage tumblers 4. On the other side of the contacting slider 7 a cam 8 is provided. This cam 8 engages in a recess 9 in the slider bolt 10, whereby both slider bolt 10 and contacting slider 7 are engaged with and fit together with each other under an elastic force.

Between both contacting slider 7 and slider bolt 10 mentioned above a core covering 11 is positioned, which fits tightly in the chamber 3. To provide for motion of the cam 8 the core covering 11 has a slot 12. For sealing of this slot 12 between the slider bolt 10 and the core covering 11 a sealing member 13, e.g. a plate or sheet, is positioned, which is allowed to slide with the cam 8 over the core covering 11.

The slider bolt 10 has on its upper surface the projections 14, which in a way familiar in the prior art are positioned in an axial groove 23 of the cylinder housing 24 with the lock cylinder set in its 0- position, and therefore will slide axially with the slider bolt 10. The slider bolt 10 can take a position in which the projections 14 align with the associated circular channels or grooves 31 of the cylinder housing 24, so that the cylinder core 1 can rotate and operate the lock to which it belongs (which is not shown here in greater detail).

The bolt member 22 or its slider bolt 10 has two control tips 15 and 16 positioned at opposite ends thereof. These control tips 15 and 16 cooperate with control surfaces 17 and 18 of two control rings 19 and 20. The control surfaces 17 has a convex segment 21 and the control surface 18 has a corresponding concave segment 26. The control rings 19 and 20 are rotationally fixed with respect to the cylinder housing 24. The control ring 19 sits in a cavity of the cylinder housing 24, whereby the shoulder 27 engages and locks in the axial groove 23, and thereby prevents rotation of the control ring 19 with respect to the cylinder housing 24. The control ring 20 sits in a circular shaped recess of cylinder core 1, and is mounted on a base advantageously constructed in two pieces.

The projecting piece 28 of the base protrudes toward the exterior in the axial groove 23 of the housing, and prevents rotation of the control ring 20 mounted on it with the cylinder core 1.

By the above-described structure a positively actuated control is provided for the bolt member 22. When the correct key 25 is inserted in the key channel 2, the key magnets 29 assume the position indicated in FIG. 1, and the cylinder core 1 is rotated by the key 25. The control tips 15 and 16 run along the control surfaces 17 and 18, whereby the control tip 16 is pushed out of the concave segment 26, and the control tip 15 is moved under the convex segment 21. An axial sliding of the bolt member 22 occurs then (in FIGS. 1 and 2 to the right). The contacting elements 6 are then slid into the notches 5 of the rotatable magnetic tumblers 4, and the projections 14 on the other side of the bolt member 22 reach positions in which they are aligned with the circular grooves 31, so that a further rotation of the cylinder core 1 is possible.

When an incorrect key is inserted, at least one of the rotatable magnetic tumblers 4 assumes a position in which the contacting elements 6 do not lie opposite their associated notches 5. With a rotation of the cylinder core 1 the start of the sliding of the bolt member 22 is prevented. The projections 14 do not reach a position, in which they align with the circular grooves 31.

Figure 2:
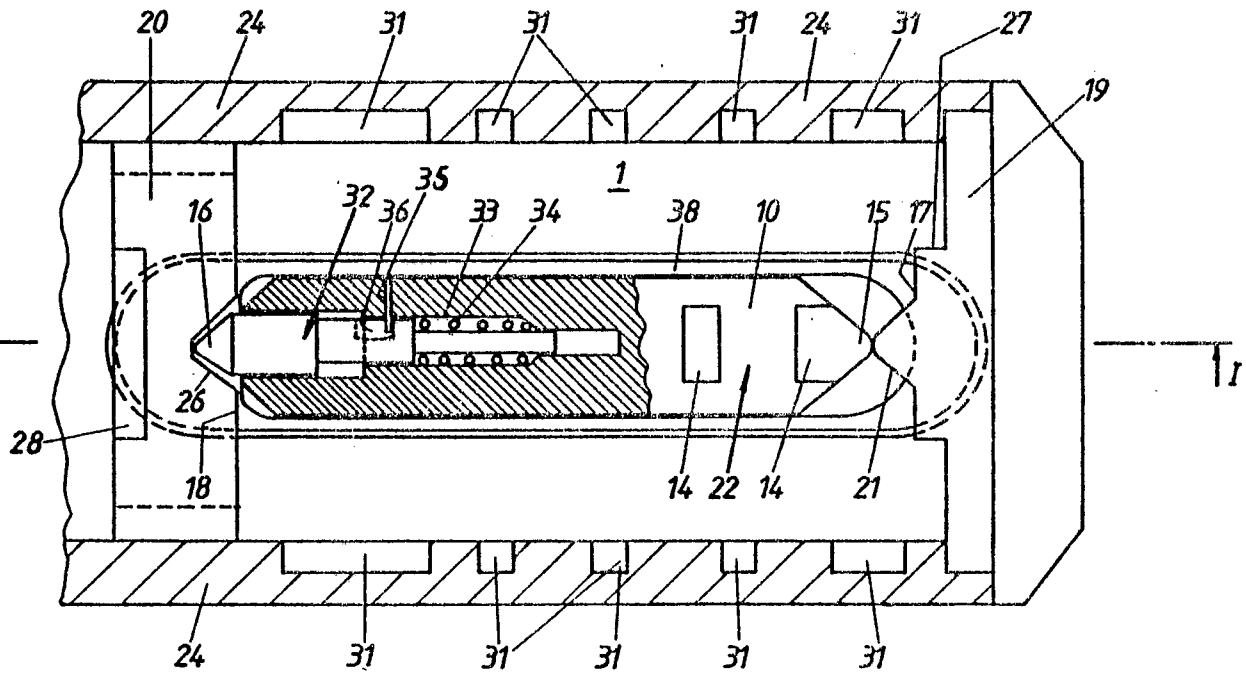
FIG. 2 is a cross sectional view of the lock cylinder of FIG. 1 as seen in the direction of the arrow II of FIG. 1.

When one tries to rotate the cylinder core 1 with an incorrect key 25, as described above, the slider bolt 10 sits in the position shown in FIGS. 1 and 2, that is, the bolt member 22 is not shifted to the right.

Because of the width of the axial groove 23 a relative sliding of the control tip 16 and the bolt member 22 between the control rings 19 and 20 occurs, whereby the control tip 16 runs over the concave control surface 26 and the control tip 16 is pushed into the steplike cavity 33 of the slider bolt 10. Because of that a further relative rotation of the cylinder core 1 is permitted, until the projections 14 contact the housing surfaces 37, which are formed in the axial groove 23 on lands between the circular grooves 31.

Further rotation of the cylinder core 1 and operation of the lock is therefore effectively prevented, whereby the force of the relatively thick projections 14 is absorbed by the lock. The rotatable magnetic tumblers 4 are thereby largely relieved and must take only the reduced force due to the spring 34.

By the suitable dimensioning of a pin recess 36 of a first control pin 32 a second control pin 35 mounted in bolt member 22 and protruding into the pin recess 36 has so much play, that first control pin 32 is pivotable a known amount about its long axis and is displaceable axially. The position of the control tip 16 follows the shape of the concave control surface 26. Thus the wear on the control ring 20 is reduced and manufacture of the control ring 20 is simplified, since the concave segment 26 of the control surface 18 can be provided by a simple milling operation. The concave segment 26 must not be spherical.

The apparatus according to our invention has the advantage that the force required for release of this force limiting coupling can be exactly controlled, since it depends on the compressibility of the spring 34. The spring 34 must be so strong, that for normal operation, it guarantees that the control tip 16 remains extended, so that the controlling force provided by both the control surfaces 18 and 17 is actually operative. The component parts of the tumblers 4 and the other controlling parts are thinly dimensioned, since they have to bear only a small force.

By a tight fit of the core covering 11 and the division of the bolt member 22 into a contacting slider 7 and a slider bolt 10 the sensitive interior of the lock cylinder is protected against dust, vapor and dampness.

In the specific embodiment shown the control ring 20 is so positioned that the concave segment 26 lies further interiorly than convex segment 21. The entire arrangement can also be reversed, so that the sliding of the bolt member 22 can occur in the other direction. The control rings 20 and 19 can also be formed in a single piece with the housing. The rotatable magnetic tumbler construction is shown in FIG. 4 with the associated contacting elements 6 on one side of the cylinder core 1. A substantially equal structure can be constructed symmetrically on the other side of the lock, whereby the permutations for the lock combination and the locking force can be increased.

The core covering 11 can be made from plastic or from metal. For an exact guiding of the contacting slider 7 and the slider bolt 10, the core covering 11 has raised edges 38 and 39, which effect the guiding during axial shifting.

The structure according to our invention of the force limiting coupling with both control rings 19 and 20 and both control tips 15 and 16 with variable spacing from each other may be found useful with other tumbler types. Thus it is possible, for example, to substitute for the rotatable magnetic tumblers, a mechanically operable contacting pin, which operates on contact with a key. Furthermore the bolt member 22 can also be provided in one piece, as is taught in Austrian Pat. No. AT 357 430. Moreover, it is also advantageous to substitute a compressible spring for the control ring 19 with convex control surface, which presses the bolt member 22 in the direction of the control ring 20.

Figure 3:
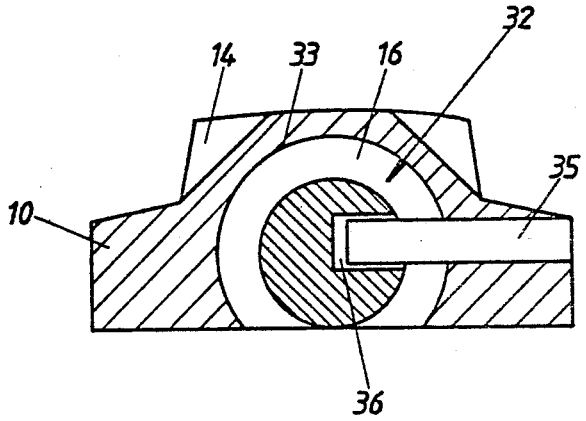
FIG. 3 is a cross sectional view of the lock cylinder of FIG. 1 taken along the section line III—III through the bolt member in the direction of the arrows.

Specifically FIG. 3 shows that the pin recess 36 of the first control pin 32 and the second control pin 35 pressing into the bolt member 22 are so dimensioned that the first control pin 32 is displaceable axially and is pivotable about its longitudinal axis, so that the rotary position of the control tip 16 can follow the shape of the control surface 18 on the concave segment 26. Nevertheless pin recess 36 and second control pin 35 act together as a limit stop device which restricts the motion of the first control pin 32 toward the exterior or in the axial direction.

We claim:

1. In a lock cylinder comprising a cylinder housing and a cylinder core having one or more rotatable magnetic tumblers supported therein, wherein in said cylinder core at least one axially slidable bolt member is provided, whose slidability is controlled by said rotatable magnetic tumblers, and said bolt member has one or more projections directed toward the exterior of said lock cylinder, the inside wall of said cylinder housing having one or more circular grooves and an axially running groove therein, wherein each of said circular grooves is, positioned axially, so that in an axially shifted position of said bolt member, in which one or more contacting elements protruding toward the interior of said lock cylinder lie in an associated notch in one of said rotatable magnetic tumblers, a release of said projections of said bolt member allowing rotation of said cylinder core is provided, the improvement wherein said bolt member has two control tips positioned at opposite ends thereof, which are guided with two control surfaces mounted so as to be nonrotatable with respect to said cylinder housing and positioned opposing each other, whereby a positively actuated control of said bolt member is provided, wherein a first one of said control surfaces has a concave segment and a second one of said control surfaces has a convex segment, and that one of said control tips is slidable against an elastic restoring force, whereby after a certain limiting force has been exceeded a relative displacement between said control surfaces of said bolt member occurs enabling a rotation of said cylinder core without collateral axial displacement of said bolt member.

2. The improvement defined in claim 1 wherein said core of said control tips slidable under an elastic restoring force comprises a pivotally supported first control pin in a cavity of said bolt member, and the displacement of said first control pin toward the exterior of said lock cylinder is limited by a limit stop device.

3. The improvement defined in claim 2 wherein said limit stop device comprises a pin recess in the side of said first control pin and a second control pin mounted rigidly in said bolt member substantially perpendicular to said first control pin, said second control pin being substantially smaller than said pin recess, so as to limit the axial displacement and rotatability of said first control pin.

4. The improvement defined in claim 3 wherein said first control pin is pivotable about the longitudinal axis thereof, so that the rotary position of said one of said control tips slidable under said elastic restoring force can follow the shape of said concave segment of said first one of said control surfaces.

5. The improvement defined in claim 4 wherein said bolt member comprises a contacting slider having said contacting elements attached thereto and a slider bolt, said contacting slider and said slider bolt being mounted on a core covering supported rigidly in said cylinder core, and said contacting slider and said slider bolt are connected, to each other by at least one cam projecting through an opening in said core covering and wherein in the vicinity of said opening of said core covering between said contacting slider and slider bolt a sealing member is provided through which said cam projects, whereby said interior of said lock cylinder is kept free of dust, moisture, and the like.

6. A lock cylinder comprising:

a cylinder housing and a cylinder core having a plurality of tumblers therein:

and an axially slidable bolt member in said core having one or more projectiosn directed toward the exterior of said lock cylinder and one or more contacting elements extended toward the interior of said lock cylinder, said bolt member being mounted slidably and at least partially rotatably in an axially directed longitudinal groove formed on the inside of the wall of said cylinder housing, the inside wall of said cylinder housing also having one or more circular grooves therein which is positioned axially into a position in which each of said contacting elements engage a respective formation in one of said tumblers, because said tumblers are properly oriented therefor by insertion of a correctly formed key in said lock cylinder, said projections are engagable in said circular grooves, so that said bolt member may be rotated further to open said lock cylinder, said bolt member having two control tips positioned at opposite ends thereof, which are guided with two control surfaces mounted so as to be nonrotatable with respect to said cylinder housing and positioned opposing each other, whereby a positively actuated control of said bolt member is provided, a first one of said control surfaces having a concave segment and a second one of said control surfaces having a convex segment, one of said control tips being slidable against an elastic restoring force, whereby after a certain limiting force has been exceeded a relative displacement of said bolt member with respect to said control surfaces occurs, such that said projections are engageable in said circular grooves and only a further rotation of said cylinder core is required to open said lock cylinder.

7. In a lock cylinder comprising a cylinder housing and a cylinder core having at least one tumbler, wherein in said cylinder core at least one axially slidable bolt member is axially oriented in response to an orientation of said tumbler, the improvement wherein said bolt member has two control tips positioned at opposite ends thereof, which are guided by two control surfaces mounted so as to be nonrotatable with respect to said cylinder housing and positioned opposing each other, so as to provide a positively actuated control of said bolt member, which is independent of the sliding force which could be provided by a spring, wherein one of said control tips is slidable aginst an elastic restoring force, whereby after a certain limiting force has been exceeded, a relative displacement of said bolt member between said control surfaces occurs enabling a subsequent rotation of said cylinder core without collateral axial displacement of said bolt member.

* * * * *

UNITED STATES PATENT AND TRADEMARK OFFICE

CERTIFICATE OF CORRECTION

PATENT NO. : 4,665,726

DATED : May 19, 1987

INVENTOR(S) : Kurt PRUNBAUER etal

It is certified that error appears in the above-identified patent and that said Letters Patent is hereby corrected as shown below: Title page:

Item [73] Assignee's name is to read:

-- EVVA-WERK SPEZIALERZEUGUNG von ZYLINDER- und SICHERHEITSSCHLOSSERN GESELLSCHAFT mbH & CO. KOMMANDITGESELLSCHAFT --.

Signed and Sealed this

Fifteenth Day of December, 1987

*Attest:*

DONALD J. QUIGG

*Attesting Officer*

*Commissioner of Patents and Trademarks*